US005158255A

United States Patent [19]

Fuller

[11] Patent Number: 5,158,255

[45] Date of Patent: Oct. 27, 1992

[54] WRIST REST APPARATUS

[76] Inventor: Thomas D. Fuller, 715 E. Northview, Phoenix, Ariz. 85020

[21] Appl. No.: 818,143

[22] Filed: Jan. 8, 1992

[51] Int. Cl.[5] ..... B43L 15/00

[52] U.S. Cl. ..... 248/118

[58] Field of Search ..... 248/118, 118.1, 118.3, 248/118.5; 400/715

[56] References Cited

U.S. PATENT DOCUMENTS

| | | | |
|---|---|---|---|
| 3,114,527 | 12/1963 | Demarest | 248/118 |
| 3,300,250 | 1/1967 | Dollgener et al. | 248/118 X |
| 3,851,919 | 12/1974 | Nagy | 248/118 X |
| 4,183,098 | 1/1980 | Knowles, Jr. | 2/16 |
| 4,226,464 | 10/1980 | Janz | 248/118 X |
| 4,545,554 | 10/1985 | Latino et al. | 248/118.1 |
| 4,798,199 | 1/1989 | Hubbard et al. | 128/87 R |
| 4,829,604 | 5/1989 | Allen et al. | 2/170 |
| 4,913,390 | 4/1990 | Berke | 248/176 |

*Primary Examiner*—Alvin C. Chin-Shue
*Attorney, Agent, or Firm*—H. Gordon Shields

[57] ABSTRACT

Wrist support apparatus includes a central core element with a yieldable foam element disposed about the central core, and an outer covering of relatively soft material. The apparatus defines a generally cylindrical element which may be placed adjacent to a keyboard by a user and which may be picked up by a user of the keyboard and used as an exercise element for a user's fingers and hands and which may be positioned in any of a variety of positions or orientations in accordance with the particular desires of the user of the particular apparatus.

7 Claims, 1 Drawing Sheet

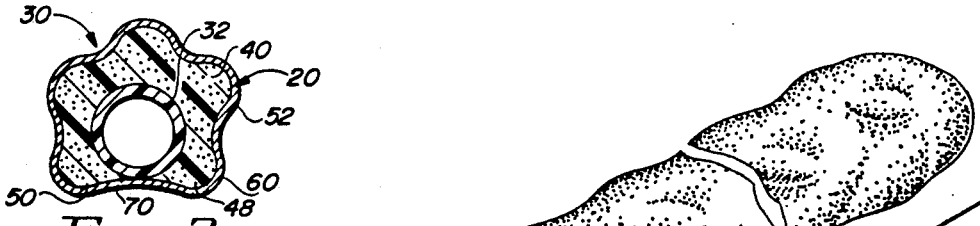
FIG. 3
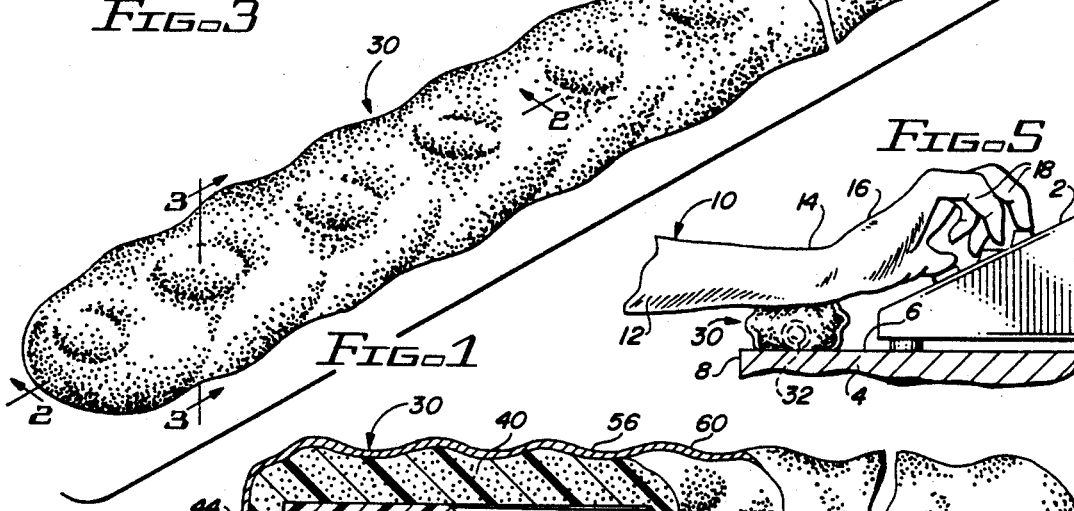
FIG. 1
FIG. 5
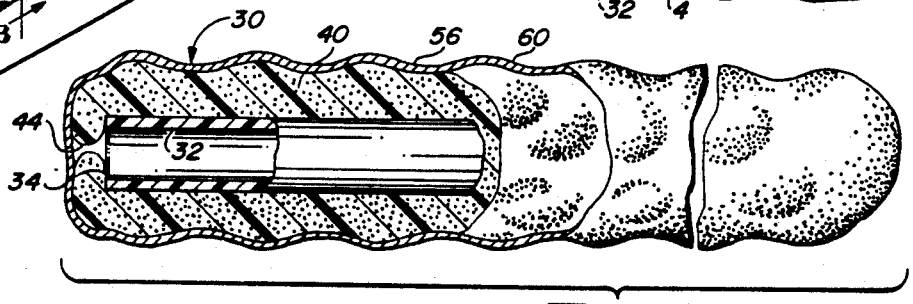
FIG. 2
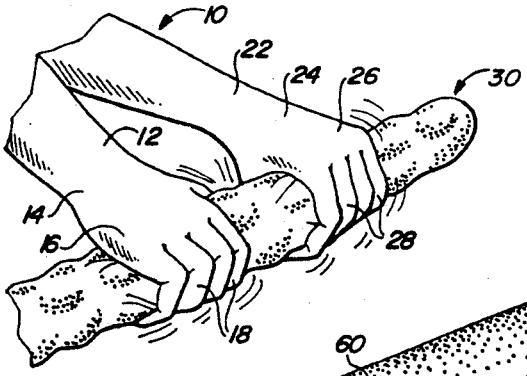
FIG. 6
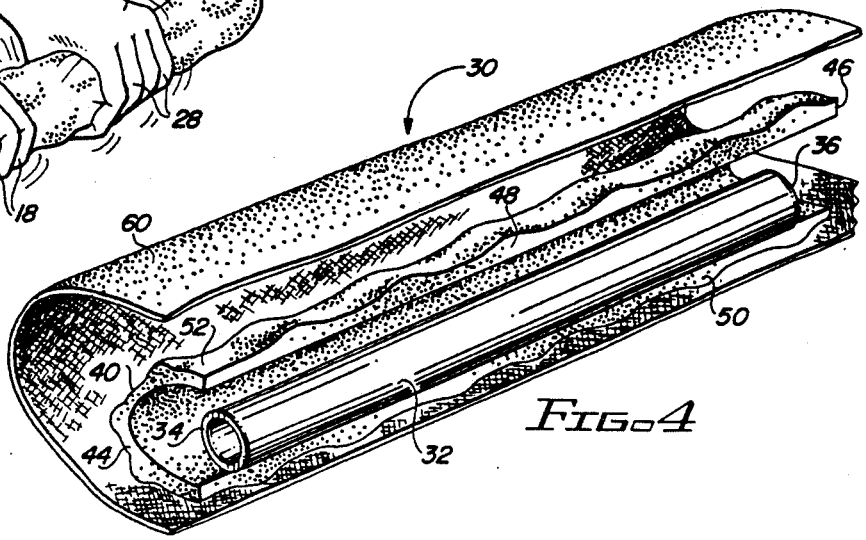
FIG. 4

WRIST REST APPARATUS

BACKGROUND OF THE INVENTION

1. Field of the Invention

This invention relates to apparatus on which wrists may be rested and, more particularly, apparatus which may be secured to a typewriter, a keyboard, and the like, for resting wrists while using the keyboard, etc.

2. Description of the Prior Art

U.S. Pat. No. 4,182,098 (Knowles) discloses a wrist support which includes a relatively rigid plate and straps for securing the relatively rigid plate to the wrist of a user.

U.S. Pat. No. 4,545,554 (Latino et al) discloses a wrist support which may be secured to a keyboard for supporting the user's wrists. The wrist support comprises a plate which fits under a keyboard and a support element extending upwardly from the plate. The support element is adjustable, and the adjustable elements are specifically claimed. That is, it appears that the adjustable elements comprise the specific invention.

U.S. Pat. No. 4,798,199 (Hubbard et al) discloses a wrist support securable to the wrist of a user. The apparatus includes a base plate having two portions disposed at an obtuse angle to each other. There is a pad over the base plate, and straps are used for securing the base plate pad to the wrist of a user.

U.S. Pat. No. 4,829,604 (Allen et al) discloses another support apparatus for a wrist. The apparatus comprises a band having a plurality of layers securable to the wrist of a user.

U.S. Pat. No. 4,193,390 (Berke) discloses a wrist support for a computer keyboard. The wrist support is secured to a keyboard and is adjustable vertically and horizontally for the convenience of the user.

Of the above discussed patents, only the '554 (Latino et al) and the '390 (Berke) patent pertain specifically to the subject matter of the apparatus of the present invention. That is, only those two patents are designed to support the wrist of a user of a keyboard. However, the elements involved in those two patents include relatively complicated structural elements, and the portion of the apparatus which actually contacts the wrist of the user in both cases is generally flat and relatively unyielding with respect to the movement of a user's wrist as the user moves the hand and wrist over the keyboard.

The apparatus of the present invention includes a variable surface and it may be positioned easily for the convenience of the user with respect to a keyboard, and need not be secured directly to a keyboard.

SUMMARY OF THE INVENTION

The invention described and claimed herein comprises a wrist support for a user of a keyboard and the support is fully portable and may be disposed adjacent to a keyboard in accord with the user's comfort. The apparatus includes a tubular form or core with a variable or irregular surface foam cushion over the core and with a relatively soft fabric covering the cushion. The relatively soft fabric allows a user's wrist to move along the apparatus without frictional burns, or the like, which may result from the use of hard fabrics or materials, and which soft fabric also substantially eliminates the problem of sweating. The variable or irregular surface provides a changing environment for a user and accordingly helps to relieve stress that may occur when a single surface configuration is used. Moreover, the apparatus is generally of a tubular configuration and provides an element for exercising the fingers and hands. That is, the apparatus may be picked up by the user and may be used as an exercise element for the fingers and hands, as or when desired.

Among the object of the present invention are the following:

To provide new and useful wrist support apparatus for a user of a keyboard;

To provide new and useful apparatus for supporting wrists of a user adjacent to a keyboard;

To provide a tubular rest element which may be moved and picked up by a user for exercising the fingers and hands;

To provide a wrist support element having a variable outer configuration;

To provide new and useful wrist support apparatus having a generally cylindrical unyieldable core covered with an irregular surfaced foam element and having a relatively soft fabric outer covering; and To provide new and useful apparatus for supporting the wrist of a user having a generally cylindrical configuration and including a foam element usable as an exercise element for fingers and hands.

BRIEF DESCRIPTION OF THE DRAWING

FIG. 1 is a perspective view of the apparatus of the present invention.

FIG. 2 is a view in partial section taken generally along line 2—2 of FIG. 1.

FIG. 3 is a view in partial section taken generally along line 3—3 of FIG. 1.

FIG. 4 is an exploded perspective view of the apparatus of the present invention.

FIG. 5 is a side view illustrating the apparatus of the present invention in a use environment.

FIG. 6 is a perspective view illustrating the apparatus of the present invention in another use environment.

DESCRIPTION OF THE PREFERRED EMBODIMENT

FIG. 1 is a perspective view of wrist rest apparatus 30 of the present invention. FIG. 2 is a view in partial section of the wrist rest apparatus 30 taken generally along line 2—2 of FIG. 1.

FIG. 3 is a view in partial section of the wrist rest apparatus 30 of the present invention taken generally along line 3—3 of FIG. 1. FIG. 4 is an exploded perspective view of the wrist rest apparatus 30 illustrating the various elements which comprises the wrist rest apparatus 30. For the following discussion, reference will primarily be made to FIGS. 1, 2, 3, and 4.

The wrist rest apparatus 30 includes a relatively rigid tubular core or form 32, with a layer of resilient foam 40 disposed about the core 30, and with a relatively soft covering 60 disposed about the foam layer 40.

The tubular or cylindrical core 32 includes an end 34 and an end 36. The ends 34 and 36 are disposed generally parallel to each other.

The foam layer 40 disposed about the core 32 is slightly longer than the core 32. The foam layer 40 includes an end 44 and an end 46 disposed adjacent to the ends 34 and 36, respectively, of the core 32. The foam 40 also includes a pair of generally longitudinally or axially extending edges 48 and 50. The edges 48 and 50 are disposed against each other, or adjacent to each other, so that the foam 40 defines an outer tube or sleeve for the tubular core 32.

As best shown in FIG. 2, the overall length of the foam 40 is slightly longer than that of the core 32 so that the ends 34 and 36 of the core 32 are covered by the ends 44 and 46, respectively, of the foam 40. In FIG. 2, the end 34 of the core 32 is shown covered or enclosed by the end 44 of the foam 40.

From FIG. 4, it will be appreciated that the overall width of the foam 40, between the edges 48 and 50, is substantially the same as the circumference of the tubular core 32. This may also be understood from reference to FIG. 3. The tubular core 32 is accordingly substantially covered by the foam layer 40. However, if desired, the edges 48 and 50 may be disposed against each other so that the core 32 is completely enclosed, rather than having the apparatus 30 include a bottom 70. The bottom 70 is shown in FIG. 3. The bottom 70, while not exactly or substantially flat, yet comprises a generally or somewhat flat area or portion on which the apparatus may be disposed in a use environment. The use environment will be discussed in detail below in conjunction with FIG. 5.

As shown in all of the Figures, the foam layer 40 includes an irregular or variable surface 52. The irregular surface 52 may be described as an egg crate type foam surface. The advantage of having an irregular surface 52 is that a user's wrist will be contacted in different locations and in different degrees by the irregular surface.

The foam layer 40 is preferably secured, as by an appropriate adhesive, to the tubular core 32. After the foam layer 40 is secured to the tubular core 32, a covering 60 is indisposed over the foam 40. The covering 60 conforms to the irregular outer surface configuration of the foam layer 40. This is illustrated in FIGS. 1, 2, and 3. It is also shown in FIGS. 5 and 6 and will be discussed in more detail in conjuction therewith.

The covering 60 is preferably a soft tricot fabric, which is generally a nylon or nylon blend fabric. The soft tricot covering 60 provides a smooth "feel" for the apparatus 30, and allows the apparatus to "breathe" in that a users wrists will not sweat, etc., from or while being disposed on the covering 60 of the apparatus 30.

As shown in FIGS. 1 and 2, the covering 60 comprises a sleeve element which substantially fully or completely encloses the foam 40 and the tubular core 32.

FIGS. 5 and 6 illustrate the wrist rest apparatus 30 in two use environments. In FIGS. 5, a keyboard 2 is shown disposed on a top surface 6 of a desk 4. The apparatus 30 is disposed on the top surface 6 adjacent to a front edge 8 of the desk 4, and spaced apart from the keyboard 2 a distance which, of course, is variable and is in accordance with the desires of a user. Since the apparatus 30 is not fixed in place, it may be located or placed by a user in any desired location so as to provide support for the user's wrists.

Portions of a right arm and hand of a user 10 are shown in FIG. 5. The apparatus 30 is disposed beneath a wrist 14 of a user. The anatomical portion of the user 10 illustrated in FIG. 5 includes a portion of a forearm 12, the wrist 14, a hand 16, and fingers 18. The fingers 18 of the hand 16 are shown disposed on the keyboard 2, and make appropriate contact with keys on the keyboard 2.

The wrist 14 is disposed on the wrist rest apparatus 30. The wrist rest apparatus 30 provides a variable surface or irregular surface on which the wrist 14 may be disposed. The variable surface provides a relatively changing area which may contact the wrist 14 to help both rest and exercise the wrist and to prevent the wrist from being irritated, as may happen with a relatively smooth rest and a relatively smooth and "hard" covering, such as vinyl, etc. Rather, the soft fabric covering 60, together with the irregular outer periphery or surface 52 of the foam 40 provides, with the resiliency of the foam 40, a relatively soft and yielding support for the wrist 14. As the wrist moves along the keyboard and along the apparatus 30, the variable or irregular surface acts as a built-in exercise element for the wrist.

Another use environment of the apparatus 30 is illustrated in FIG. 6. Since the apparatus 30 is not fastened down, but may be moved to any desired location on the top surface 6 of the desk 8, it may be placed as appropriate for the user's wrists. Moreover, as shown in FIG. 6, the apparatus 30 may be used as an exercise element for a user's fingers. In FIG. 6, in addition to the right forearm 12, and the wrist 14, hand 16, and fingers 18, a left forearm 22, with a left wrist 24, a left hand 26, and left fingers 28, are also shown. The hands 16 and 26 with their fingers 18 and 28 are grasping and squeezing the apparatus 30 to provide exercise for the fingers, the hand, the wrist, and the forearms.

After a period of time at a keyboard, the ability to pick up the wrist rest apparatus 30 and squeeze to provide exercise for the users forearm, wrist, hand, and fingers, provides a necessary or advantageous change of pace for relaxing the fingers, hand, etc., and helps to prevent fatigue, etc., and the carpal tunnel syndrome which is prevalent in keyboard users.

The core element 32 is preferably relatively rigid or non-yielding. The core element 32 also provides the necessary or desirable base weight for the apparatus 30 to prevent the apparatus from "wandering" while in use. That is, the apparatus 30, while movable, as desired, has sufficient weight or mass to remain in a desired location while in use, as shown in FIG. 5. On the other hand, the apparatus 30 may also be picked up and used as an exercise element, as shown in FIG. 6, without undue strain to or by the user 10.

What I claim is:

1. Wrist rest and exercise apparatus, for a user's wrists, hands, and fingers comprising, in combination:

core means comprising a generally cylindrical core for providing a relatively rigid form;

resilient means disposed on and surrounding the core means for providing a cushion for a user's wrist and having a generally irregular surface for providing a relatively changing area for contacting the user's wrists; and covering means disposed about the resilient means and comprising an outer covering completely enclosing both the core means and the resilient means on which a user's wrists may be disposed and which may be grasped by a user's hand for picking up the apparatus for exercising the hand and the fingers of the hand.

2. The apparatus of claim 1 in which the core means comprises a tubular element.

3. The apparatus of claim 1 in which the resilient means comprises a resilient foam element.

4. The apparatus of claim 1 in which the covering means comprises a relatively soft fabric.

5. The apparatus of claim 4 in which the covering means further comprises a tricot material.

6. The apparatus of claim 1 in which the generally irregular surface comprises an egg crate type surface.

7. The apparatus of claim 1 in which the resilient means includes a bottom on which the apparatus may be disposed for use as a wrist rest.

* * * * *